US011125507B2

(12) United States Patent
Lin et al.

(10) Patent No.: US 11,125,507 B2
(45) Date of Patent: Sep. 21, 2021

(54) HEAT DISSIPATING APPARATUS USING PHASE CHANGE HEAT TRANSFER

(71) Applicant: TAIWAN MICROLOOPS CORP., New Taipei (TW)

(72) Inventors: Chun-Hung Lin, New Taipei (TW); Chun-Teng Chiu, New Taipei (TW); Yi-Chung Chen, New Taipei (TW); Chih-Wei Wang, New Taipei (TW)

(73) Assignee: TAIWAN MICROLOOPS CORP., New Taipei (TW)

( * ) Notice: Subject to any disclaimer, the term of this patent is extended or adjusted under 35 U.S.C. 154(b) by 119 days.

(21) Appl. No.: 16/690,723

(22) Filed: Nov. 21, 2019

(65) Prior Publication Data

US 2021/0156620 A1 May 27, 2021

(51) Int. Cl.
*F28D 15/00* (2006.01)
*F28D 15/02* (2006.01)
*F28D 1/053* (2006.01)

(52) U.S. Cl.
CPC ..... *F28D 15/0266* (2013.01); *F28D 1/05316* (2013.01)

(58) Field of Classification Search
CPC ..... F28D 15/0266; F28D 1/05316
USPC ..... 165/104.21
See application file for complete search history.

(56) References Cited

U.S. PATENT DOCUMENTS 7,686,071 B2 * 3/2010 Silverstein ..... F28D 15/0266 165/110
8,567,482 B2 * 10/2013 Yin ..... F25B 30/06 165/10
9,157,687 B2 * 10/2015 Schon ..... F28D 15/0275
10,641,556 B1 * 5/2020 Al Omari ..... F28D 15/02
2006/0162898 A1 7/2006 Reyzin et al.
2017/0273216 A1 9/2017 Chainer et al.

FOREIGN PATENT DOCUMENTS

CN 1875238 A 12/2006
CN 203788635 U 8/2014
TW 201445103 A 12/2014
TW I478659 B 3/2015
TW M589819 U 1/2020

OTHER PUBLICATIONS

Office Action dated Feb. 12, 2020 of the corresponding Taiwan patent applicaiton.

* cited by examiner

*Primary Examiner* — Davis D Hwu
(74) *Attorney, Agent, or Firm* — Chun-Ming Shih; HDLS IPR Services

(57) ABSTRACT

A heat dissipating apparatus using phase change heat transfer includes a box, a heat conductive block, a working fluid, and a heat transfer device. The box has a first shell plate and a second plate between both of which a chamber is defined. An opening is formed through the first shell plate. The heat conductive block is disposed corresponding to the opening; a portion of the heat conductive block is formed inside the chamber and the other portion of the heat conductive block is exposed out of the first shell plate. The working fluid is disposed in the chamber and in contact with the heat conductive block. The heat transfer device has an evaporator section installed inside the chamber to absorb the heat generated by the working fluid after phase change. Thus, the heat dissipating efficiency of the whole apparatus can be enhanced.

9 Claims, 8 Drawing Sheets

HEAT DISSIPATING APPARATUS USING PHASE CHANGE HEAT TRANSFER

BACKGROUND OF THE INVENTION

Field of the Invention

The present invention relates to a heat dissipating apparatus, and in particular, to a heat dissipating apparatus using phase change heat transfer.

Description of Prior Art

A continuous increase in the operating speeds of the electronic devices causes more and more heat to be generated. To solve the issue of significant heat generation effectively, the industry has combined the high thermal-conductivity vapor chamber or heat pipe with other heat transfer device as a heat dissipating apparatus. However, the existing heat dissipating apparatus needs substantial improvements in heat conduction and heat dissipation efficiencies.

The traditional heat dissipating apparatus mainly comprises a vapor chamber and a cooling fin set. The cooling fin set is attached to an end surface of the vapor chamber through surface-mount technology; a wick structure and a working fluid are provided inside the vapor chamber.

Though the traditional heat dissipating apparatus has the function of heat dissipation, it suffers from the following disadvantages during operation. The vapor chamber quickly conducts heat by means of phase change of the internal working fluid. Thus, when the heat arrives at the cooling fin set, a poor situation of heat accumulation occurs between the vapor chamber and the cooling fin set because the efficiency of heat dissipation of the latter is far lower than that of the former. As a result, the heat dissipation efficiency of the whole heat dissipating apparatus is unsatisfactory.

In view of this, the inventor pays special attention to research with the application of related theory and tries to improve and overcome the above disadvantages regarding the prior art, which becomes the improvement target of the inventor.

SUMMARY OF THE INVENTION

One objective of the present invention is to provide a heat dissipating apparatus which can quickly conduct great heat to the heat transfer device through the phase change of the heated working fluid to enhance the heat dissipating efficiency of the whole apparatus.

To achieve the above objective, the present invention provides a heat dissipating apparatus using phase change heat transfer, which comprises a box, a heat conductive block, a working fluid, and a heat transfer device. The box has a first shell plate and a second shell plate sealing and covering the first shell plate correspondingly. A chamber is defined between the first shell plate and the second shell plate. An opening is formed through the first shell plate. The heat conductive block is disposed corresponding to the opening; a portion of the heat conductive block is formed inside the chamber and the other portion of the heat conductive block is exposed out of the first shell plate. The working fluid is disposed in the chamber and in contact with the heat conductive block. The heat transfer device has an evaporator section which is installed inside the chamber to absorb the heat generated by the working fluid after phase change.

The present invention also has the following effects. By means of the evaporator section having two bent pipes disposed in parallel and bypassing the external edge of the frame, the heated area of the evaporator section is increased to improve the efficiency of heat conduction. Through the dispositions of the seal pad and the seal ring, the sealing effects between the heat conductive block and the first shell plate and between the first shell plate and the second shell plate can be improved. The heat dissipating apparatus of the present invention can be applied in a vertically or horizontally mounted display card.

DETAILED DESCRIPTION OF THE INVENTION

Figure 1:
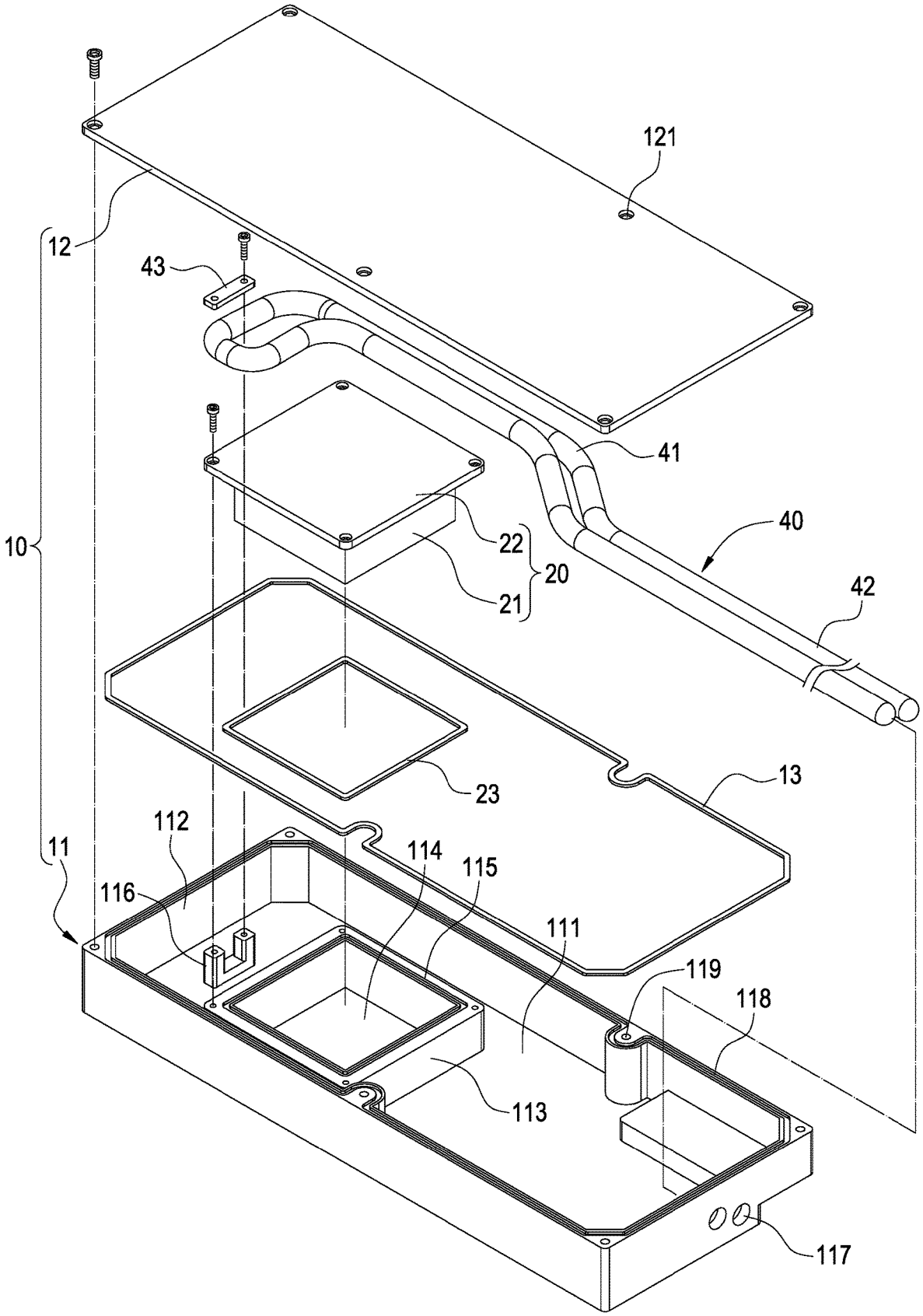
FIG. 1 is an exploded view of the heat dissipating apparatus using phase change heat transfer of the present invention.
Figure 2:
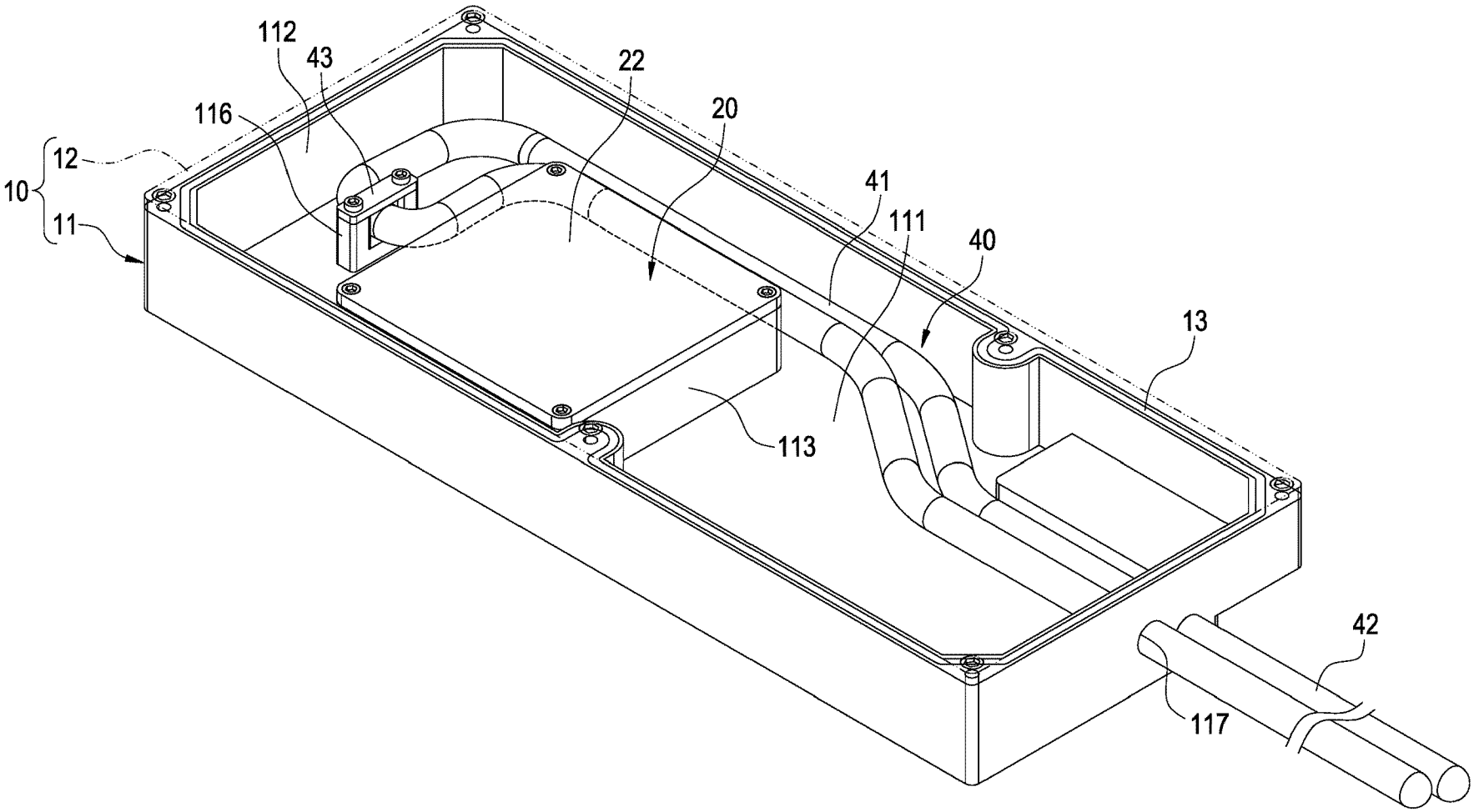
FIG. 2 is an assembled perspective view of the heat dissipating apparatus using phase change heat transfer of the present invention.
Figure 3:
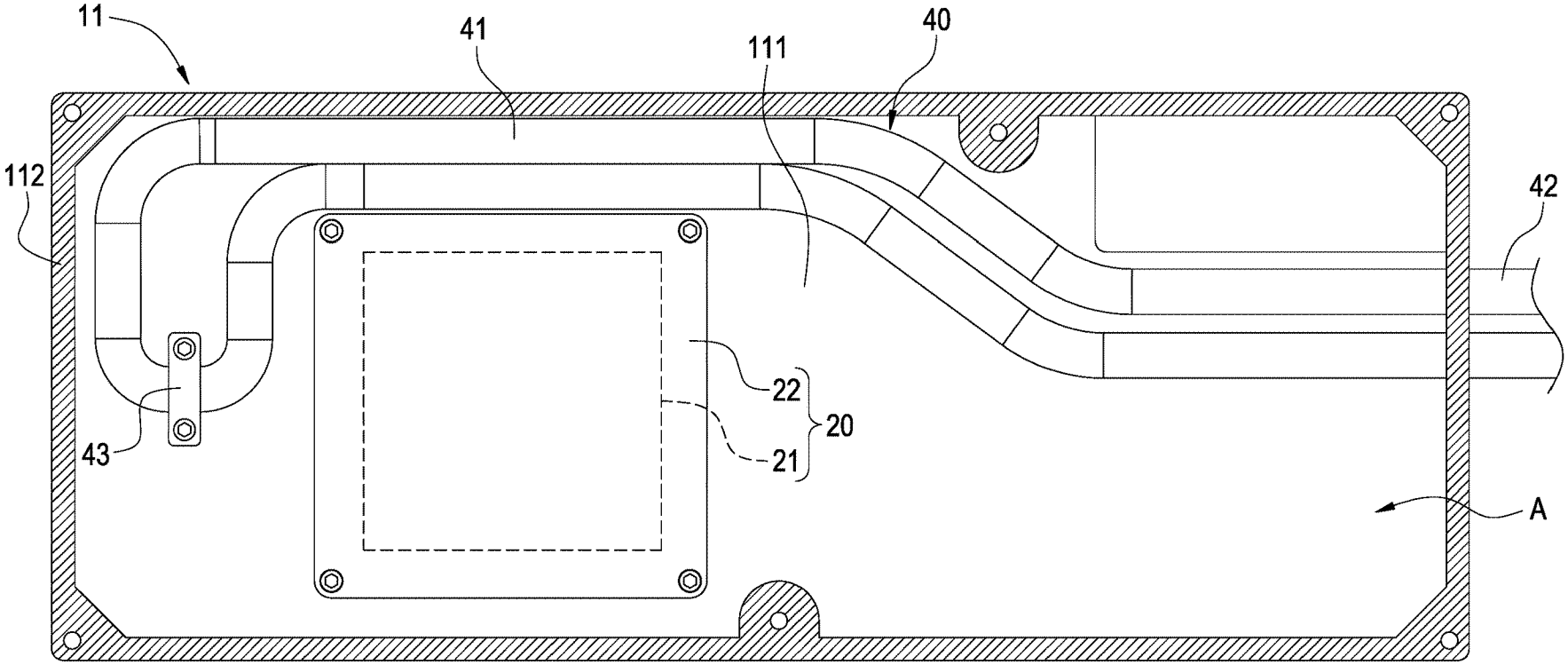
FIG. 3 is an assembled cross-sectional view of the heat dissipating apparatus using phase change heat transfer of the present invention.
Figure 4:
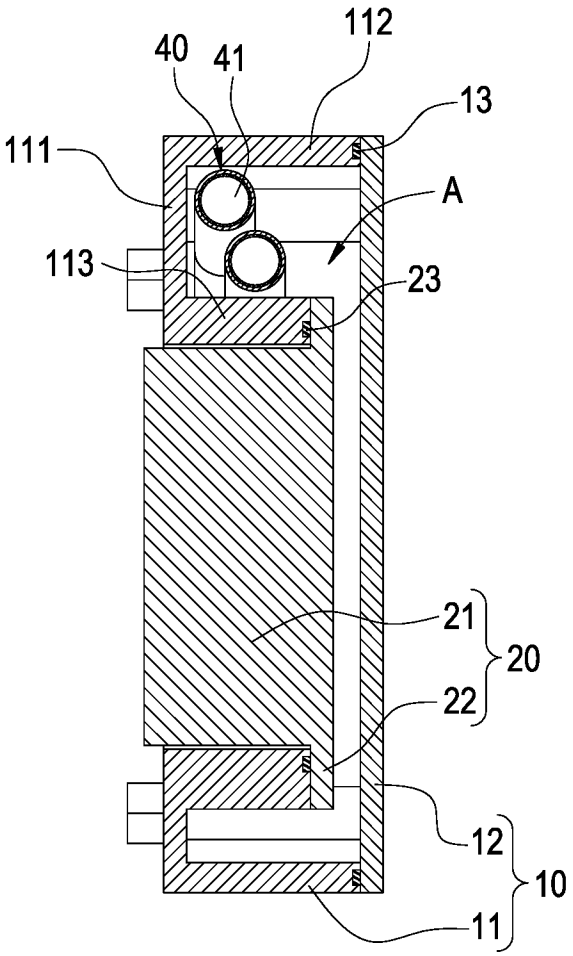
FIG. 4 is an assembled cross-sectional view of the heat dissipating apparatus using phase change heat transfer of the present invention from another view.

The detailed description and technical details of the present invention will be explained below with reference to accompanying figures. However, the accompanying figures are only for reference and explanation, but not to limit the scope of the present invention.

Please refer to FIGS. 1-4. The present invention provides a heat dissipating apparatus using phase change heat transfer, which mainly comprises a box 10, a heat conductive block 20, a working fluid 30, and a heat transfer device 40.

The box 10 has a first shell plate 11 and a second shell plate 12. Both of the first and the second shell plates 11, 12 can be made of aluminum, copper, or the alloy thereof. The first shell plate 11 comprises a bottom plate 111 and a surrounding plate 112 bent from the edge of the bottom plate 111. The frame 113 extends from the left side of the bottom plate 111; the opening 114 is formed at the center of the frame 113. A first annular groove 115 is formed on the top surface of the frame 113.

Moreover, a U-shaped support 116 is disposed near the left side of the frame 113; two throughholes 117 are formed on a side of the surrounding plate 112 away from the frame 113; a second annular groove 118 is formed on the top surface of the surrounding plate 112. Further, a plurality of screw holes 119 are formed at four corners and at the middle of the surrounding plate 112.

The second shell plate 12 seals and covers the first shell plate 11 correspondingly; a chamber A is defined between the first shell plate 11 and the second shell plate 12. A plurality of holes 121 are formed on the second shell plate 12 corresponding to the above-mentioned screw holes 119.

Furthermore, a seal pad 13 is disposed in the second annular groove 118; the seal pad 13 is clamped between the first shell plate 11 and the second shell plate 12. By means of the screw fasteners such as screws disposed through the holes 121 and screwed to the above-mentioned screw holes 119, the first shell plate 11 and the second shell plate 12 are combined and sealed together.

The heat conductive block 20 is made of high heat conductivity material like copper or the alloy thereof. In the current embodiment, the heat conductive block 20 mainly comprises a block body 21 and a plate 22 expanding from the edge of an end of the block body 21. The block body 21 penetrates through the opening 114; the plate 22 is limited at an end surface of the frame 113. A seal ring 23 is disposed in the above-mentioned first annular groove 115. The seal ring 23 is clamped between the frame 113 and the plate 22 in which the plate 22 is disposed inside the chamber A and an end of the block body 21 away from the plate 22 is exposed out of the first shell plate 11.

The working fluid 30 can be a liquid like pure water (refer to FIG. 6), which is injected into the chamber A and is in contact with the plate 22 of the heat conductive block 20.

In the current embodiment, the heat transfer device 40 is a heat pipe which has an evaporator section 41 and a condenser section 42 extending from the evaporator section 41. A wick structure and a working fluid are disposed inside the heat pipe. The evaporator section 41 is installed inside the chamber A to absorb the heat generated by the working fluid 30 after phase change. In the current embodiment, the evaporator section 41 has two bent pipes disposed in parallel. The sealed end of the evaporator section 41 is disposed on the U-shaped support 116 and is fixed by a pressing plate 43 and two screws; the rest of the evaporator section 41 bypasses an external edge of the frame 113 and passes through the two throughholes 117 of the first shell plate 11 to form the above-mentioned condenser section 42 outside the first shell plate 11.

Figure 5:
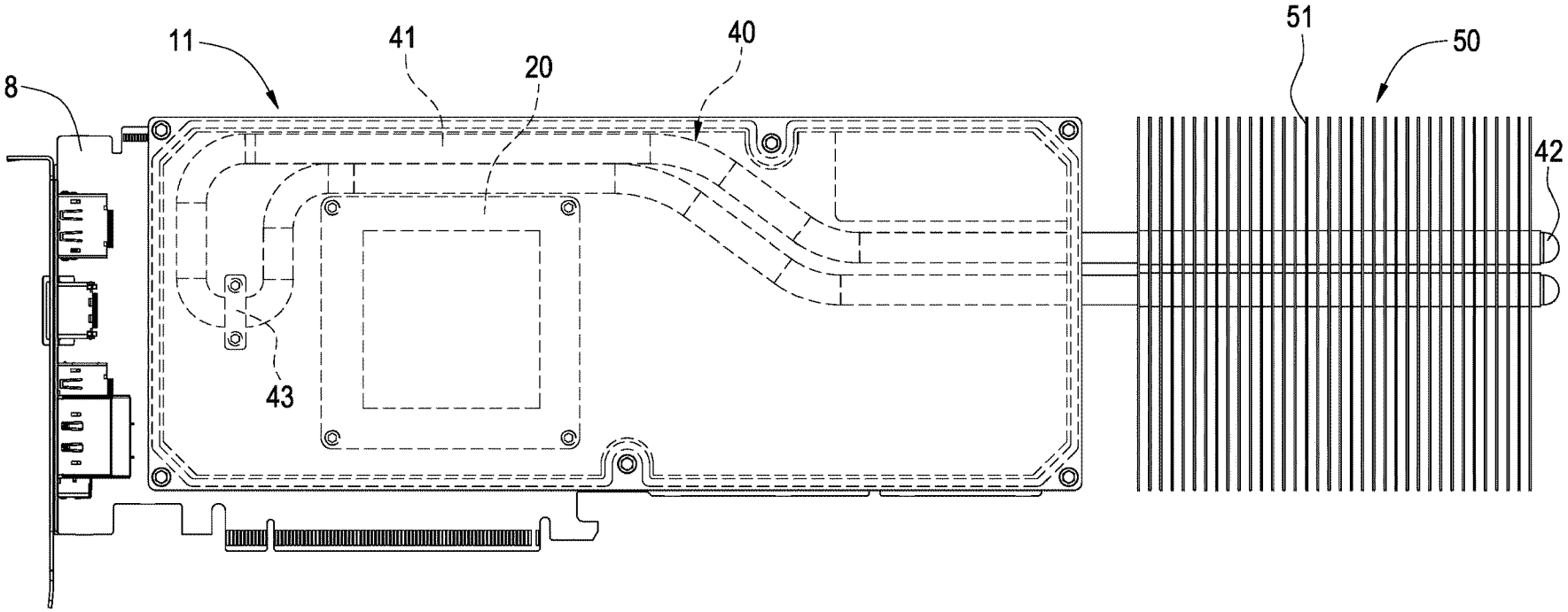
FIG. 5 is an assembled schematic view of the present invention applied in a vertically mounted display card.
Figure 6:
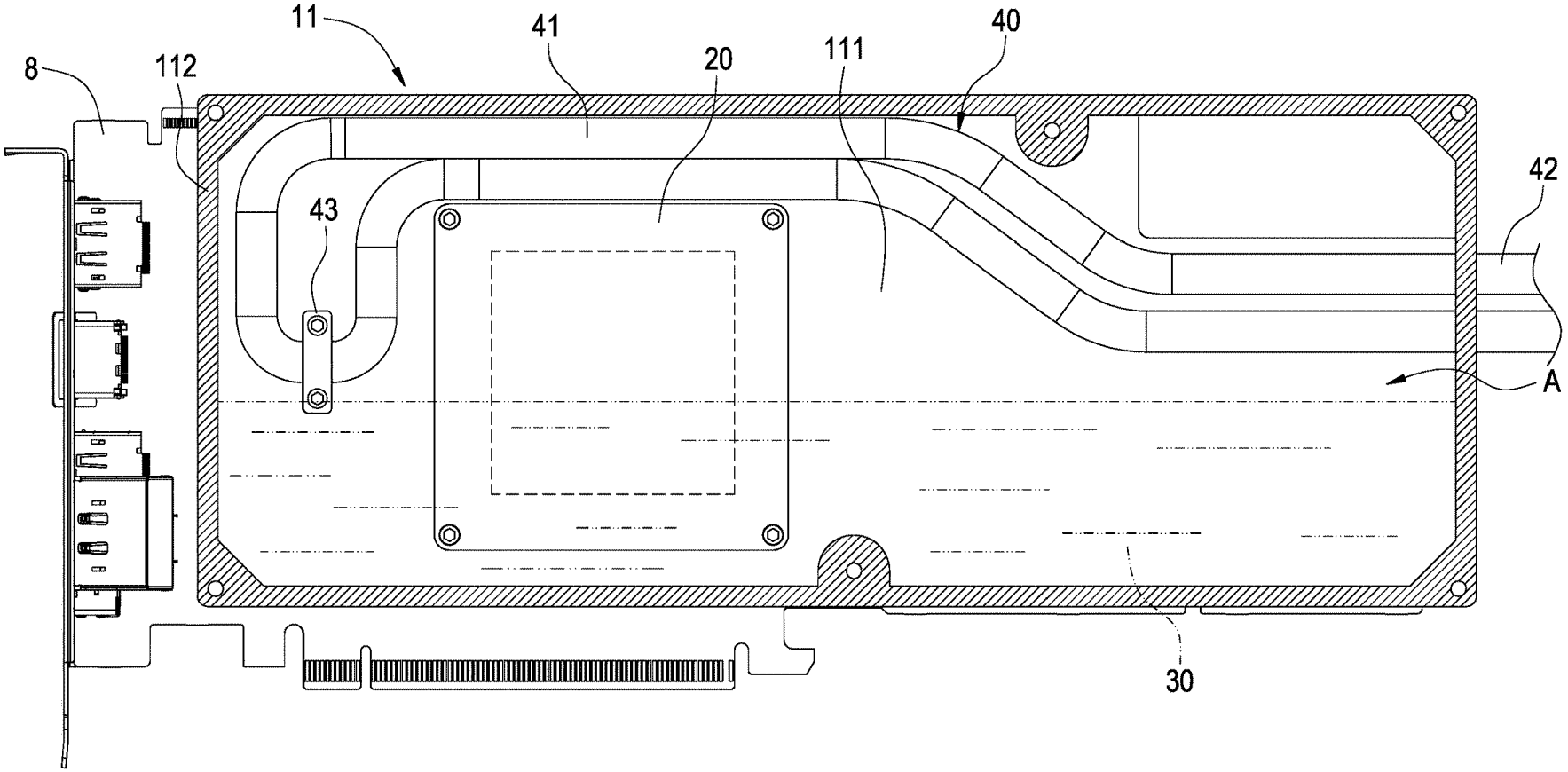
FIG. 6 is an assembled cross-sectional view of the present invention applied in a vertically mounted display card.

Please refer to FIGS. 5 and 6. The heat dissipating apparatus using phase change heat transfer of the present invention which further has a cooling module 50 can be applied in the heat dissipation of the display card 8. In the current embodiment, the cooling module 50 is made of a plurality of cooling fins 51 stacked together. The cooling fins 51 are individually connected to the above-mentioned condenser section 42 in sequence.

During the assembly, the box 10 is placed vertically near a side of the display card 8. Then, the end surface of the block body 21 of the heat conductive block 20 is attached to the heat source of the display card 8 and thus the display card 8 in the current embodiment is disposed vertically in which the working fluid 30 does not reach the evaporator section 41 of the heat transfer device 40.

During the operation, great heat at high temperature occurs at the heat source of the display card 8. The great heat is conducted to the working fluid 30 in liquid form through the heat conductive block 20. After receiving the great heat continuously, the working fluid 30 in liquid form will be evaporated into the working fluid 30 in vapor form which carries the great heat and flows toward the evaporator section 41 of the heat transfer device 40. The evaporator section 41 absorbs the heat generated by the working fluid 30 after phase change to transform the working fluid 30 therein from the liquid form into the vapor form and conducts the heat to the condenser section 42. In this way, a second effect of fast heat dissipation can be achieved.

Figure 7:
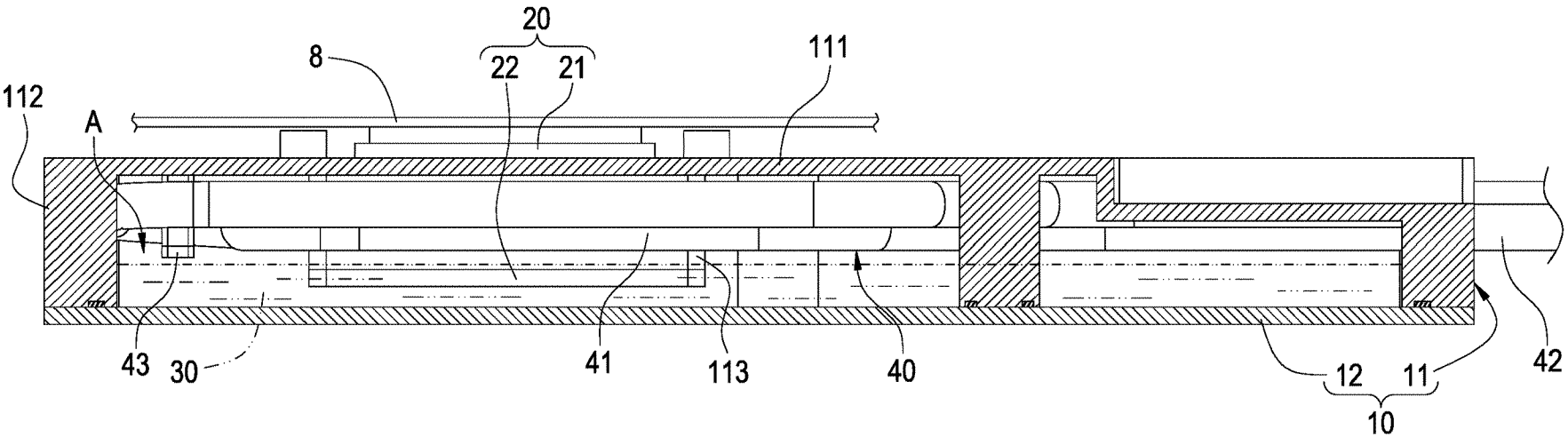
FIG. 7 is an assembled cross-sectional view of the present invention applied in a horizontally mounted display card.

Please refer to FIG. 7. The display card 8 can be placed not only vertically as described previously but also horizontally according to different demands in which the working fluid 30 does not reach the evaporator section 41 of the heat transfer device 40.

Figure 8:
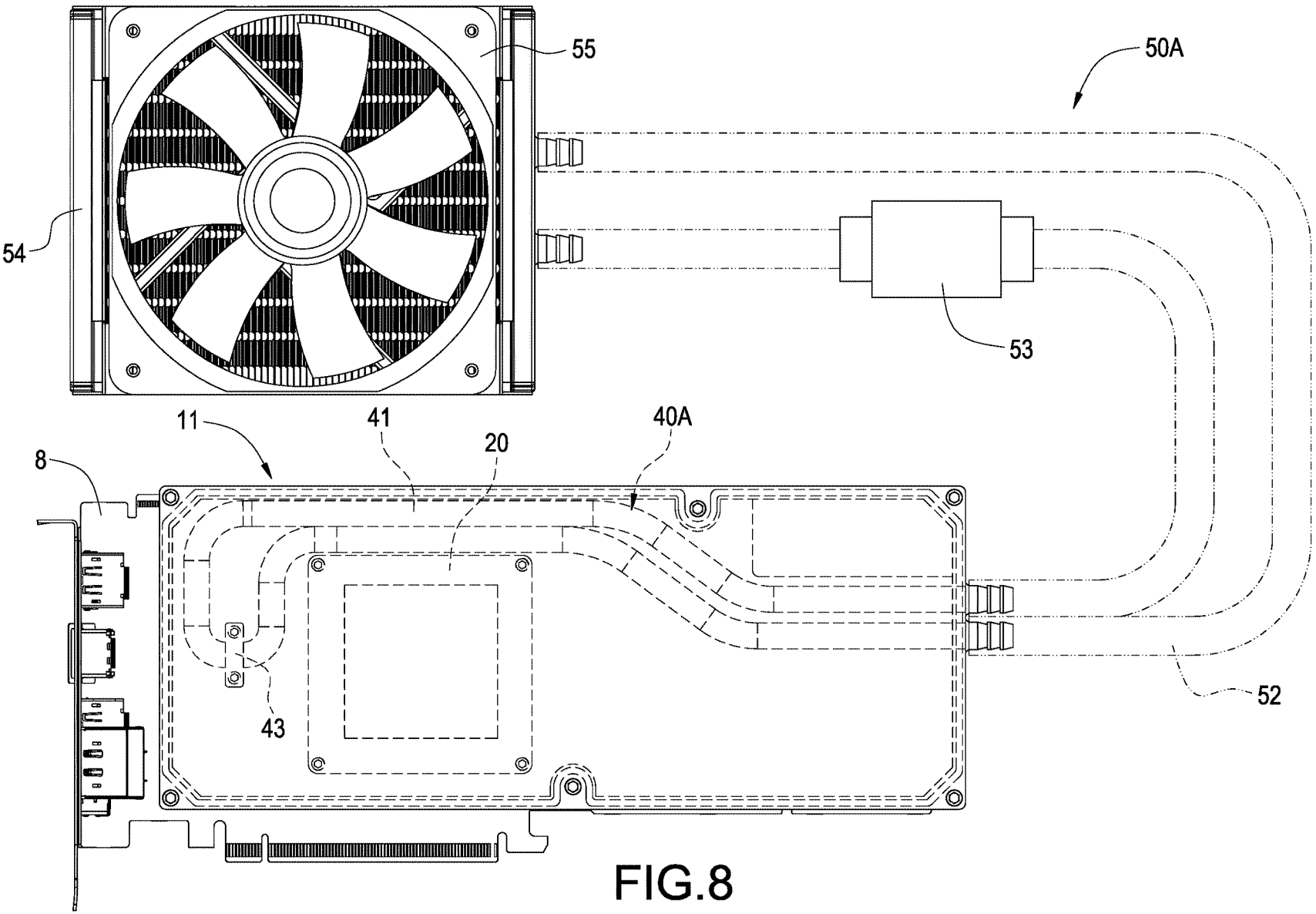
FIG. 8 is an assembled schematic view according to another embodiment of the present invention applied in a vertically mounted display card.

Please refer to FIG. 8 which shows the heat dissipating apparatus using phase change heat transfer according to another embodiment of the present invention. In the current embodiment, the heat transfer device 40A is a metal pipe which has an evaporator section 41. The cooling module 50A mainly comprises two delivery tubes 52, a water pump 53, a radiator 54, a cooling fan 55, and a coolant (not shown). Two ends of one of the two delivery tubes 52 are individually connected to a pipe of the heat transfer device 40A and the inlet of the radiator 54; two ends of the other of the two delivery tubes 52 are individually connected to the other pipe of the heat transfer device 40A and the outlet of the radiator 54. The water pump 53 is installed on either of the two delivery tubes 52. The cooling fan 55 is installed on a side of the radiator 54. The coolant is filled in the metal pipe, the two delivery tubes 52, and the radiator 54. After the evaporator section 41 absorbs the heat generated by the working fluid 30 after phase change, the heat in the evaporator section 41 is removed through the operation of the water pump 53 and is dissipated through the radiator 54 and the cooling fan 55.

In summary, the heat dissipating apparatus using phase change heat transfer of the present invention indeed achieves the expected objectives and overcomes the problems of the prior art. Also, the present invention is novel, useful, and non-obvious to be patentable. Please examine the application carefully and grant it as a formal patent for protecting the rights of the inventor.

What is claimed is:

1. A heat dissipating apparatus using phase change heat transfer, comprising:

a box having a first shell plate and a second shell plate sealing and covering the first shell plate correspondingly, wherein a chamber is defined between the first shell plate and the second shell plate, wherein an opening is formed through the first shell plate;

a heat conductive block disposed corresponding to the opening, wherein a portion of the heat conductive block is formed inside the chamber and the other portion of the heat conductive block is exposed out of the first shell plate;

a working fluid disposed in the chamber and being in contact with the heat conductive block;

a heat transfer device having an evaporator section which is installed inside the chamber to absorb the heat generated by the working fluid after phase change; and a cooling module, wherein the heat transfer device is a heat pipe which further has a condenser section extending from the evaporator section, the condenser section is formed outside the box, and the cooling module is sleeved around the condenser section.

2. A heat dissipating apparatus using phase change heat transfer, comprising:

a box having a first shell plate and a second shell plate sealing and covering the first shell plate correspondingly, wherein a chamber is defined between the first shell plate and the second shell plate, wherein an opening is formed through the first shell plate;

a heat conductive block disposed corresponding to the opening, wherein a portion of the heat conductive block is formed inside the chamber and the other portion of the heat conductive block is exposed out of the first shell plate;

a working fluid disposed in the chamber and being in contact with the heat conductive block;

a heat transfer device having an evaporator section which is installed inside the chamber to absorb the heat generated by the working fluid after phase change; and a cooling module, wherein the heat transfer device is a metal pipe, the cooling module comprises two delivery tubes, a water pump, and a radiator, two ends of one of the two delivery tubes are individually connected to an end of the metal pipe and the radiator, two ends of the other of the two delivery tubes are individually connected to the other end of the metal pipe and the radiator, and the water pump is installed on either of the two delivery tubes.

3. The heat dissipating apparatus using phase change heat transfer according to claim 2, wherein the cooling modules further has a cooling fan which is installed on a side of the radiator.

4. The heat dissipating apparatus using phase change heat transfer according to claim 1, wherein the working fluid does not reach the evaporator section of the heat transfer device.

5. The heat dissipating apparatus using phase change heat transfer according to claim 1, wherein the first shell plate comprises a bottom plate and a surrounding plate bent from an edge of the bottom plate, a frame extends from the bottom plate, and the opening is formed at the center of the frame.

6. The heat dissipating apparatus using phase change heat transfer according to claim 5, wherein the heat conductive block comprises a block body and a plate expanding from an end of the block body, the block body penetrates through the opening, and the plate is limited at an end surface of the frame.

7. The heat dissipating apparatus using phase change heat transfer according to claim 6, wherein a first annular groove is formed on a top surface of the frame, a seal ring is disposed in the first annular groove, and the seal ring is clamped between the frame and the plate.

8. A heat dissipating apparatus using phase change heat transfer, comprising:

a box having a first shell plate and a second shell plate sealing and covering the first shell plate correspondingly, wherein a chamber is defined between the first shell plate and the second shell plate, wherein an opening is formed through the first shell plate;

a heat conductive block disposed corresponding to the opening, wherein a portion of the heat conductive block is formed inside the chamber and the other portion of the heat conductive block is exposed out of the first shell plate;

a working fluid disposed in the chamber and being in contact with the heat conductive block; and a heat transfer device having an evaporator section which is installed inside the chamber to absorb the heat generated by the working fluid after phase change;

wherein the first shell plate comprises a bottom plate and a surrounding plate bent from an edge of the bottom plate, a frame extends from the bottom plate, and the opening is formed at the center of the frame;

wherein two throughholes are formed on a side of the surrounding plate away from the frame, a U-shaped support is disposed near a side of the frame, the evaporator section has two bent pipes disposed in parallel, a portion of the evaporator section is disposed on the U-shaped support and is fixed by a pressing plate, and the rest of the evaporator section bypasses an external edge of the frame and passes through the two throughholes of the first shell plate.

9. The heat dissipating apparatus using phase change heat transfer according to claim 5, wherein a second annular groove is formed on a top surface of the surrounding plate, a seal pad is disposed in the second annular groove, and the seal pad is clamped between the first shell plate and the second shell plate.

* * * * *